United States Patent [19]

Herman

[11] Patent Number: 4,702,380

[45] Date of Patent: Oct. 27, 1987

[54] MERCHANDISE DISPLAY ASSEMBLY

[76] Inventor: David Herman, 33 Commerce Rd., Carlstadt, N.J. 07072

[21] Appl. No.: 39,719

[22] Filed: Apr. 20, 1987

[51] Int. Cl.[4] ..... A47F 7/00

[52] U.S. Cl. ..... 211/57.1; 211/59.1; 211/181

[58] Field of Search ..... 211/57.1, 54.1, 59.1, 211/87, 106, 94, 96, 181

[56] References Cited

U.S. PATENT DOCUMENTS 3,608,740 9/1971 Bowman ..... 211/96
3,659,722 5/1972 Carroll ..... 211/106
4,109,795 8/1978 Koningsford et al. ..... 211/57.1
4,217,986 8/1980 Brown ..... 211/57.1

*Primary Examiner*—J. Franklin Foss
*Assistant Examiner*—Sarah A. Lechok Eley
*Attorney, Agent, or Firm*—Mark T. Basseches; Paula T. Basseches

[57] ABSTRACT

A merchandising display system includes a gridwork within which merchandise display brackets may be optimally adjustably supported. The applied brackets are resistant to lateral sliding movement and assume a first angularity when mounted to one side of the grid and a different angularity when mounted to the other side.

4 Claims, 6 Drawing Figures

FIG. 4
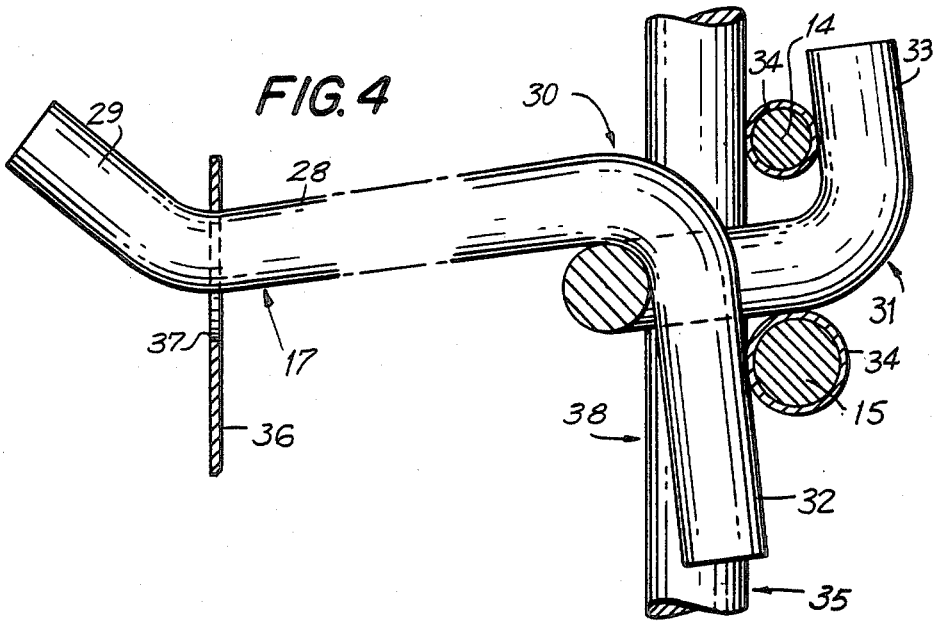
FIG. 5
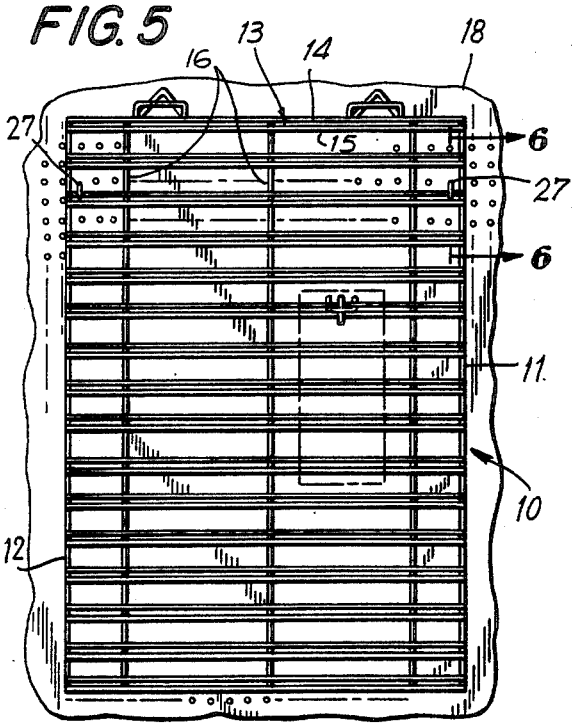
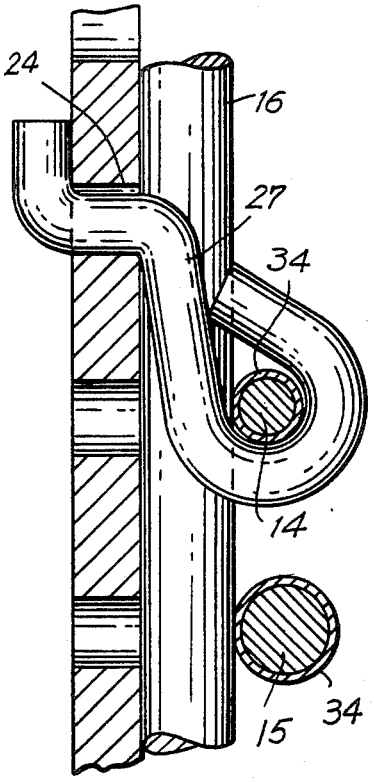
FIG. 6

MERCHANDISE DISPLAY ASSEMBLY

BACKGROUND OF THE INVENTION

1. Field of the Invention

The present invention is directed to an improved merchandise display rack, and more particularly relates to a display rack adapted for the merchandising of "carded" products, namely blister packed articles, such as automobile replacement parts and components mounted on cards.

2. The Prior Art

It is conventional to display carded pre-packaged items encased in blister packs on brackets supported from pegboards. The brackets include a horizontally extended arm or arms terminating in upwardly directed lips to prevent the inadvertent displacement of packaged items.

The items include a perforation or perforations slidably received on the arms of the brackets.

The brackets include mounting means having spaced fingers adapted to be shifted through and behind adjacent apertures in the pegboard when the bracket is tilted, and a brace member which engages the front surface of the pegboard when the bracket is pivoted downwardly to its operative or display position.

In order to assure that the brackets are not displaced from the pegboard during handling of the articles or movement of the pegboard, the connection of the brackets to the pegboard may be secured with wires or clips.

Merchandising assemblies of the type described are inefficient particularly in that the horizontal spacing between the various bracket members is dictated by the spacing of the pegboard apertures. It is obviously desirable to maximize the number of products displayed in a given space. The use of pegboard mounted devices of the type described mandates specific intervals of spacing between supporting brackets, with the result that adjacent products may be spaced unduly far apart, with resultant space wastage or unduly close together, providing a situation in which a given product cannot conveniently be removed without disturbing and perhaps inadvertently dislodging adjacent products.

As frequently occurs, a dislodged product may not be replaced or may be improperly replaced, covering products of a different sort.

SUMMARY OF THE INVENTION

The present invention may be summarized as directed to improvements in merchandising devices, particularly of merchandising devices for card mounted products.

In accordance with the invention there is provided a grid comprised of a bordering frame and horizontally directed pairs of rods interposed between the structure of the frame. The paired rods define a slot therebetween. Between the paired rods bracket members, known per se, may be mounted.

The bracket members in a given horizontal slot may be mutually spaced in desired distances one from another so that adjacently displayed products may be spaced optimally, to maximize useful display space while at the same time providing sufficient space between adjacent products to permit ready access thereto. In this manner products may be removed without disturbing adjacent products.

In accordance with the invention the likelihood of accidentally dislodging a conventional bracket from the grid is minimized by providing that the upper of the rods defining a given horizontally extending bracket holder assembly is relatively flexible, so that when a weight is applied to the bracket the upper rod will deflect slightly forwardly in the direction of the products supported on the rod. The lower of the rods is of larger diameter and rigid.

The grid enables brackets to be supported from either face thereof and, due to the disparate diameters of the rods defining the bracket holder assemblies, the product support arm will be disposed horizontally if mounted on one face of the grid and at a slightly inclined angle if mounted on the other face of the grid.

Optionally but preferably, the surfaces of the rods defining the holder assemblies are covered or coated with a polymeric material into which the engaging portions of the bracket members are slightly embedded under the influence of the weight of product, whereby lateral displacement of the bracket members relative to the grid during handling is minimized.

It is accordingly an object of the invention to provide an improved merchandising display device.

A further object of the invention is the provision of a device of the type described wherein conventional brackets of the type heretofore employed with pegboards may be mounted on the face of the grid in an idealized horizontally mutually displaced spacing in accordance with the width of the product merchandized.

Still a further object of the invention is the provision of a device of the type described wherein the brackets are securely supported to the grid structure with minimal likelihood of inadvertent demounting thereof.

A still further object of the invention is the provision of a device of the type described wherein brackets may be mounted to either the front or the rear surface of the display grid and the brackets will assume either a horizontal or slightly inclined orientation relative to the grid, in accordance with the side of the grid on which the bracket is mounted.

In order to attain these objects and such further objects as may appear herein or be hereinafter pointed out, reference is made to the accompanying drawings forming a part hereof.

BRIEF DESCRIPTION OF THE DRAWINGS

FIG. 4 is a magnified section taken on the line 4—4 of FIG. 1;

FIG. 5 is a front elevational view of the device;

FIG. 6 is a magnified vertical section taken on the line 6—6 of FIG. 5.

DETAILED DESCRIPTION OF THE VIEWS

Figure 1:
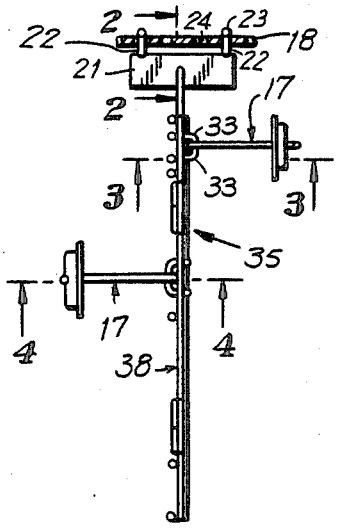
FIG. 1 is a top plan view of a merchandising device in accordance with the invention.
Figure 2:
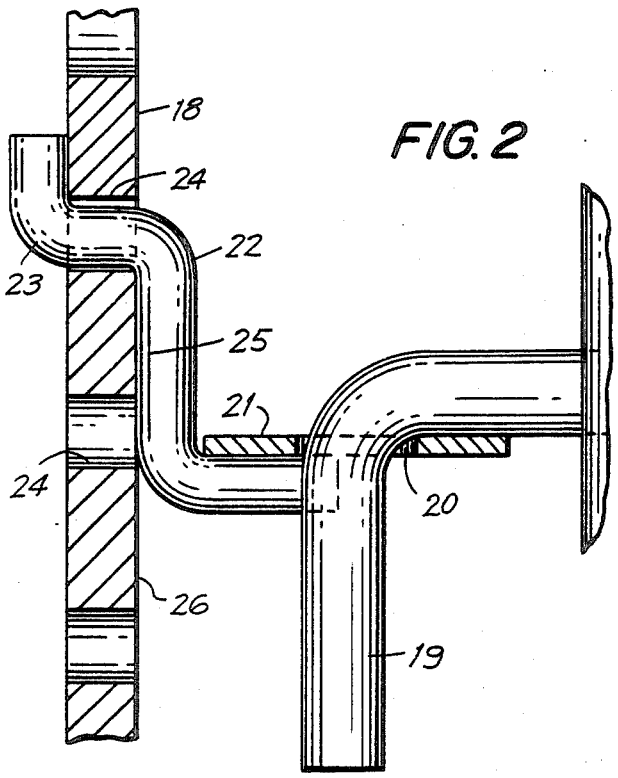
FIG. 2 is a magnified vertical section taken on the line 2—2 of FIG. 1.

Referring now to the drawings, there is disclosed in FIGS. 1 and 5 plan and front elevational view respectively, of a merchandising device in accordance with the invention, the device in FIG. 5 being shown mounted against a surface of a pegboard wall and the device of FIG. 1 being pivotally supported from the pegboard wall.

More specifically, the device comprises a gridwork 10 composed of vertical strut members 11, 12, interconnected by a plurality of horizontally directed bracket holder assemblies 13.

Each of the bracket holder assemblies 13 consists of an upper bar 14 and a lower bar 15, the distal ends of the assemblies being fixedly secured at vertically displaced positions to the struts 11, 12. As is best seen in FIG. 5, one or more vertically directed stabilizer bars 16 may be secured to the bracket support members 13.

As will be apparent from the above description, the grid 10 comprises essentially a vertical assembly for supporting the bracket members 17.

The grid 10 may be pivotally mounted to pegboard wall 18, as shown in FIG. 1. Mounting may be effected by passing upper and lower vertically directed trunnions 19 (one only being shown) through pivot aperture 20 formed in respective upper and lower brackets (upper only shown), each bracket having a flange 21 secured to the pegboard 18 as by a spaced pair of mounting feet 22, known per se.

The mounting feet include an L-shaped end portion 23 which is secured to the pegboard in the usual manner as by tilting the bracket, passing the end portion 23 through an aperture, such as the aperture 24 of the pegboard, and thereafter pivoting the assembly downward such that depending arm 25 of the assembly lies against the front face 26 of the pegboard.

The described mechanism is duplicated at a position adjacent the bottom of the grid, whereby the grid may be pivoted about a vertical axis defined by the spaced trunnions 19, 19.

An alternate means for mounting the device is shown in FIGS. 5 and 6 wherein hook-like members 27 pivotally secured to one or the other of the rods 14 or 15 are passed through the pegboard aperture 24 to support the gridwork against the face of the pegboard.

The means for mounting the gridwork to the pegboard or to another support, such as a stanchion, etc. form no part of the present invention, and it is obvious that alternate support means may be employed.

The merchandising device includes support brackets 17, known per se and conventionally employed in direct connection to the pegboard.

The brackets include a merchandise support arm 28 terminating at one end in an upwardly directed lip 29. At the other end 30 of the bracket there is formed a pair of horizontally disposed support fingers 31, including a downwardly directed toe member 32 and a spaced pair of upwardly directed stop lugs 33, 33.

Figure 3:
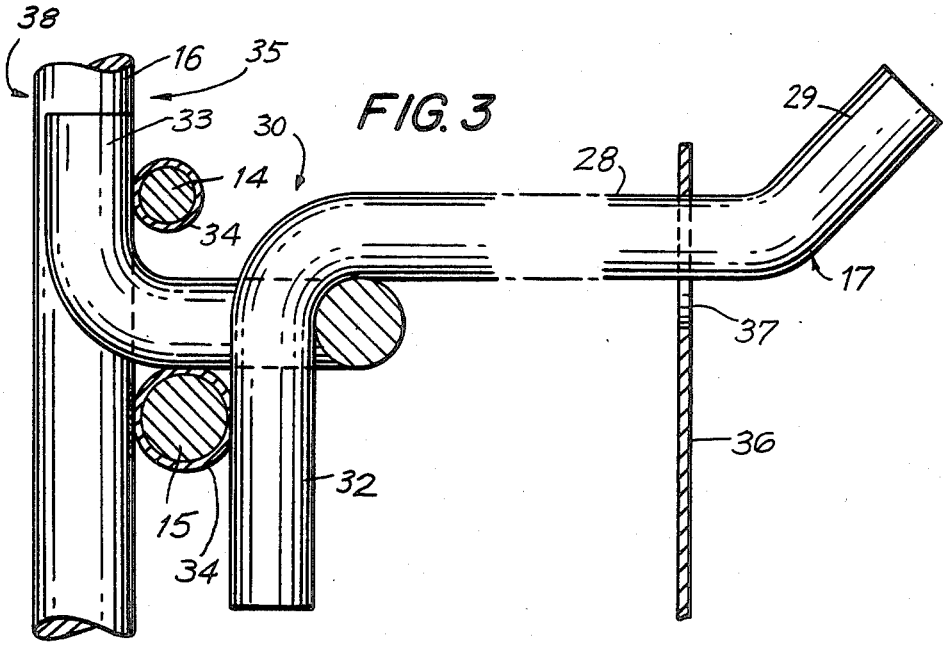
FIG. 3 is a magnified vertical section taken on the line 3—3 of FIG. 1.

As best appreciated from FIGS. 3 and 4, the lower support rod 15 forming a component of the bracket mounting assembly 13 is of greater diameter than the upper rod 14, which latter rod is relatively flexible, for reasons which will appear hereafter. In addition, the rods 14 and 15 are preferably formed with a polymeric coating 34. The coating may range from an easily deformed elastomeric to a vinyl coating or to a thick paint layer.

When the bracket 17 is mounted in the manner shown in FIG. 3 to what will be referred to as the rear face 35 of the grid, it will be appreciated that the fingers 33 will lie behind the upper rod 14 and the toe 32 will engage against the forwardly directed face of the lower rod 15, thereby disposing the support arm 28 of the bracket member in an essentially horizontal plane.

When weight is applied to the arm 28 as a result of the mounting of carded products 36 thereon (the products being provided, as is conventional, with mounting apertures 37 adapted to be sleeved over lip 29), the weight of the products will cause the rod contacting portions of the product to indent slightly into the body of the paint or coating 34 formed on the rods, thereby rendering the connection between the bracket and rods resistant to lateral sliding movement between the bracket and rods.

In addition, by virtue of the relatively deflectible nature of the upper rod 14, the weight applied to the bracket ill cause the rod slightly to deflect, augmenting the resistance of the bracket to lateral sliding movement relative to the grid.

In the orientation of FIG. 4 the bracket 17 is mounted to the front face 38 of the grid. In this orientation, due to the lesser diameter of the upper rod 14 as compared to the lower rod 15, the body 28 of the bracket will assume a slightly downwardly inclined orientation.

It will thus be perceived that, since the strut-adjacent surfaces of rods 14, 15 are in coplanar alignment, due to the greater diameter of rod 15, the same bracket will assume a first orientation when secured to the front face 38 of the grid and a different orientation when supported on the rear face 35 of the grid.

As will be apparent from the above description, adjacent brackets 17 may be spaced as desired in a horizontal direction since the spaced rods 14 and 15 do not offer the positional constraints which inhere in pegboards with their predeterminedly spaced apertures.

By virtue of the flexibility of the upper rod 14 and the presence of the coating 34, the brackets, when weighted, are substantially free from any tendency to slip or slide laterally relative to the grid.

As will be evident to those skilled in the art and familiarized with the instant disclosure, numerous variations in details of construction may be made without departing from the spirit of the invention. Accordingly, the same is to be broadly construed within the scope of the appended claims.

Having thus described the invention and illustrated its use, what is claimed as new and is desired to be secured by Letters Patent is:

1. A merchandise display device comprising a spaced parallel pair of vertical strut members, a plurality of horizontally extending, vertically spaced apart bracket holder assemblies having their distal ends mounted to said strut members and defining with said strut members an open grid, said bracket holder assemblies comprising parallel upper and lower rods, said rods being spaced to define a mounting slot therebetween, the upper said rods of said assemblies being of smaller diameter than and more flexible than said lower rods, a plurality of bracket members removably supported on said holder assemblies, said bracket members including a generally horizontally directed merchandise support arm having a free end extending away from said grid, a mounting foot at the other end of said bracket members, said foot including a downwardly directed toe member contacting a front surface of a said lower rod, a horizontally disposed spaced pair of support fingers extending through said mounting slot, and a horizontally spaced apart, upwardly extending pair of stop lugs projecting vertically from said fingers and engaging a rear surface of said upper rod, said rods including a deformable polymeric coating whereby downward forces exerted against said support arm urge said toe member, fingers and stop lugs into partially embedded relation into said coating, whereby said brackets are rendered resistant to lateral movements relative to said rods.

2. A display device in accordance with claim 1 and including vertically directed pivot means on said grid and support means for swingably receiving said pivot means.

3. A display device in accordance with claim 1 and including at least one vertically directed stabilizer bar intermediate said struts, said stabilizer bar being secured to said rods to maintain said rods in said mutually spaced condition.

4. A display device in accordance with claim 1 wherein the edge surfaces of said rods at one face of said grid are in coplanar alignment in a vertical plane and the surfaces of said lower rods project beyond the surfaces of said upper rods at the other face of said grid, whereby the support arms of brackets mounted on one face of said grid will lie at an angle relative to support arms of brackets mounted to the other face of said grid.

* * * * *